United States Patent [19]

Lemler

[11] Patent Number: 4,974,652

[45] Date of Patent: Dec. 4, 1990

[54] PLEATED CREDIT CARD HOLDER

[75] Inventor: Paul Lemler, West Bend, Wis.

[73] Assignee: Amity Leather Products Company, West Bend, Wis.

[21] Appl. No.: 433,600

[22] Filed: Nov. 6, 1989

[51] Int. Cl.[5] ..... A45C 1/00; A45C 11/18

[52] U.S. Cl. ..... 150/147; 150/144; 150/147; 150/149; 229/1.5 R; 229/25; 229/72; 229/DIG. 3

[58] Field of Search ..... D3/58, 60; 229/1.5 R, 229/DIG. 3, 75, 72; 150/147-149, 138, 144, 140, 131, 132; 206/39

[56] References Cited

U.S. PATENT DOCUMENTS

| | | | |
|---|---|---|---|
| D. 247,653 | 3/1978 | Kamenstein | D87/3 A |
| 358,277 | 2/1887 | Kay | 206/39 |
| 457,390 | 8/1891 | Weeks | 229/DIG. 3 X |
| 528,420 | 10/1894 | Estlow | 150/149 |
| 528,421 | 10/1894 | Estlow | 150/149 |
| 531,832 | 1/1895 | Brown | 229/75 |
| 621,732 | 3/1899 | Wyman | 229/1.5 R X |
| 635,582 | 10/1899 | Pedrick | 229/72 X |
| 737,232 | 8/1903 | Heeley et al. . | |
| 867,789 | 10/1907 | Bushnell, Jr. | 229/68 R |
| 1,073,768 | 9/1913 | Loveland | 150/147 |
| 1,896,573 | 2/1933 | Buxton . | |
| 2,333,798 | 11/1943 | Kner | 229/68 R |
| 2,432,557 | 12/1947 | Broughton | 150/149 |
| 2,451,122 | 10/1948 | Sherwood | 150/138 |
| 2,613,717 | 10/1952 | Jaguden | 150/139 |
| 2,665,808 | 1/1954 | McAlister | 206/73 |
| 2,694,429 | 11/1954 | Berger | 150/149 |
| 2,732,875 | 1/1956 | Martin | 150/39 |
| 2,857,948 | 10/1958 | Schlessinger et al. | 150/139 X |
| 2,959,879 | 11/1960 | Maxur | 40/124 |
| 3,067,792 | 12/1962 | Broughton | 150/39 |
| 3,187,795 | 6/1965 | Stephenson | 150/39 |
| 3,483,909 | 12/1969 | Osher et al. | 150/139 |
| 3,695,508 | 10/1972 | Hocking | 229/DIG. 3 X |
| 3,777,795 | 12/1973 | Graetz | 150/35 |
| 3,856,063 | 12/1974 | Dengel | 150/35 |
| 4,589,544 | 5/1986 | Schweinsberg | 206/45 |
| 4,667,819 | 5/1987 | Lu | 229/68 R X |

*Primary Examiner*—Sue A. Weaver

*Attorney, Agent, or Firm*—Fitch, Even, Tabin & Flannery

[57] ABSTRACT

An expanding credit card insert for holding cards and the like includes a pair of endwalls flexibly joined at their bottom edges to form a hinged seam. Pleated sidewalls extend between the endwalls, each sidewall pleat including a sidewall panel. At least one leg extends to the seam from each sidewall at a mid portion thereof, so as to space portions of the bottom edges of said sidewall panels on either side of said leg, from said seam.

9 Claims, 3 Drawing Sheets

PLEATED CREDIT CARD HOLDER

BACKGROUND OF THE INVENTION

1. Field of the Invention:

The present invention pertains to inserts for wallets and the like, adapted to receive credit cards and the like-shaped articles.

2. Description of the Related Art:

In the past, a number of different inserts have been proposed for use in wallets and the like, which have a number of different partitions for separately holding credit cards, business cards and the like-shaped articles. Nonetheless, improvements are still being sought. U.S. Pat. No. 3,483,909, for example discloses a wallet insert with multiple pockets. The pockets have full walls defining an enclosed interior, and adjacent pockets share a common wall at their central portion. The insert has end flaps which are inserted into pockets in a wallet. When the wallet is opened, the pockets of the insert are fanned out.

U.S. Design Pat. No. 247,653 discloses a multi-compartment wallet with each compartment defined by full wall sections extending throughout the entire compartment. Each compartment includes an expansion plate on either side thereof.

U.S. Pat. No. 635,582 discloses a holder for adhesive articles having a similar construction wherein each pocket is fully defined by a walled panel, but the holder differs in that it lacks expansion pleats associated with the various pockets.

U.S. Pat. No. 358,277 discloses a case for postage stamps with multiple expansion pleats located on either side of a single compartment case.

U.S. Pat. Nos. 2,694,429; 2,613,717 and 1,073,768 disclose card cases, pass cases and the like having inserts which are mounted in a wallet-like article by sliding an end flap into a pocket of the wallet.

U.S. Pat. No. 2,732,875 discloses a pocket secretary where papers are inserted into pockets having openings located at the hinge or binding of the pocket secretary.

Other arrangements for accordion-type constructions have also been found in U.S. Pat. No. 2,451,122 wherein transparent envelopes are secured to a billfold by lacing. U.S. Pat. No. 457,390 discloses a glove receptacle having an accordion-like fold out shelf for holding gloves in the pleats of the accordion. U.S. Pat. No. 2,432,557 discloses a flexible pocket receptacle having an accordion fold end-closure.

While the various accordion fold devices referred to above provide an expansion or fan-out capability, they do not provide the desired improvement in credit card holders, needed to reduce fabrication costs while providing a holder which is simple and easy to use, even when "overstuffed".

SUMMARY OF THE INVENTION

It is an object according to the present invention to provide a pleated credit card holder. A further object according to the present invention is to provide a pleated credit card holder having an improved economical construction, which provides multiple storage compartments for credit cards and the like articles.

A further object according to the present invention is to provide a pleated credit card holder of the above-described type which retains a fan-out spacing even when "overstuffed" with the various pockets of the credit card holder being filled.

These and other objects according to the present invention will become apparent from studying the appended description and related drawings.

BRIEF DESCRIPTION OF THE DRAWINGS

In the drawings, wherein like elements are referenced alike.

DETAILED DESCRIPTION OF THE PREFERRED EMBODIMENT

Figure 2:
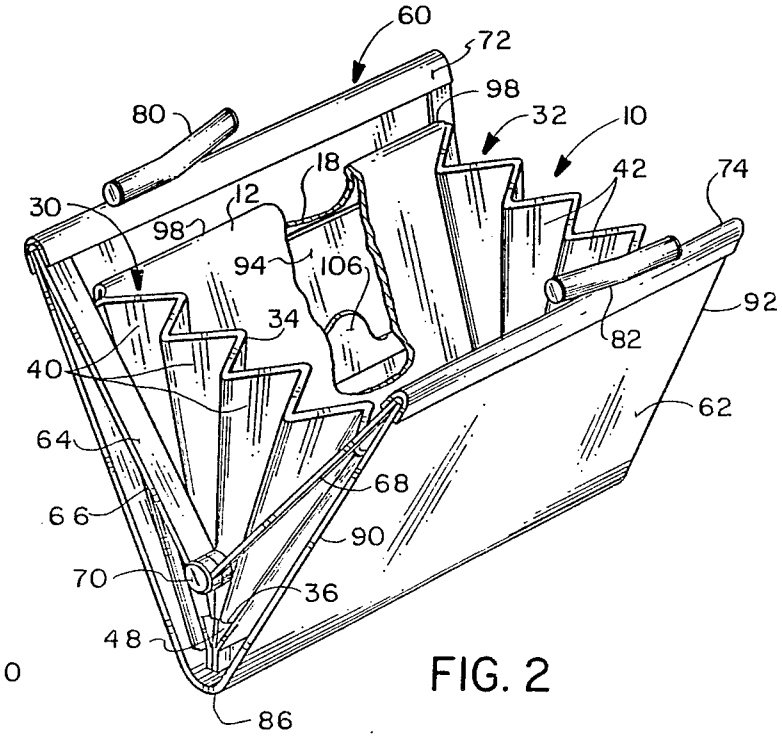
FIG. 2 is a perspective view of the insert of FIG. 1 shown mounted in a first card case.
Figure 3:
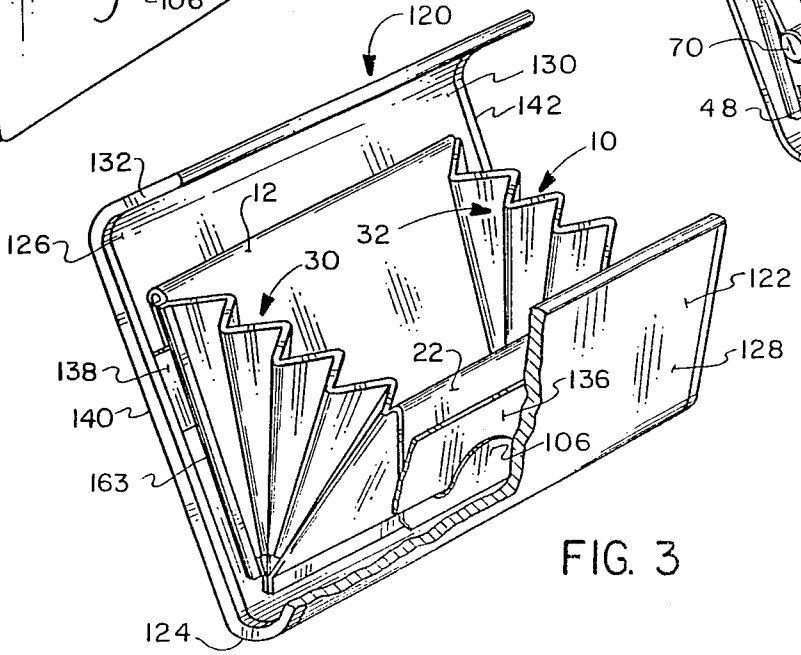
FIG. 3 is a perspective view of the insert of FIG. 1 shown installed in a second card case.
Figure 1:
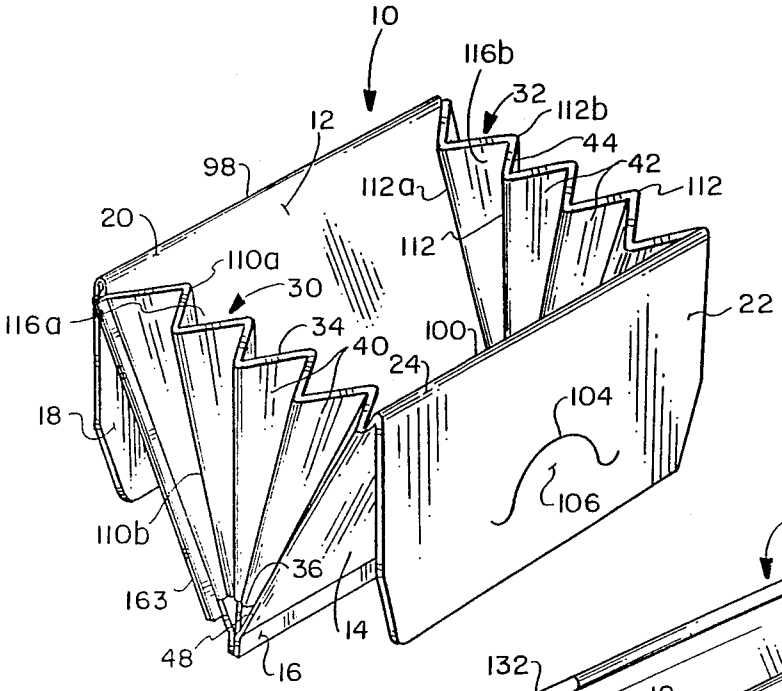
FIG. 1 is a perspective view of an insert illustrating aspects of the present invention.
Figure 4:
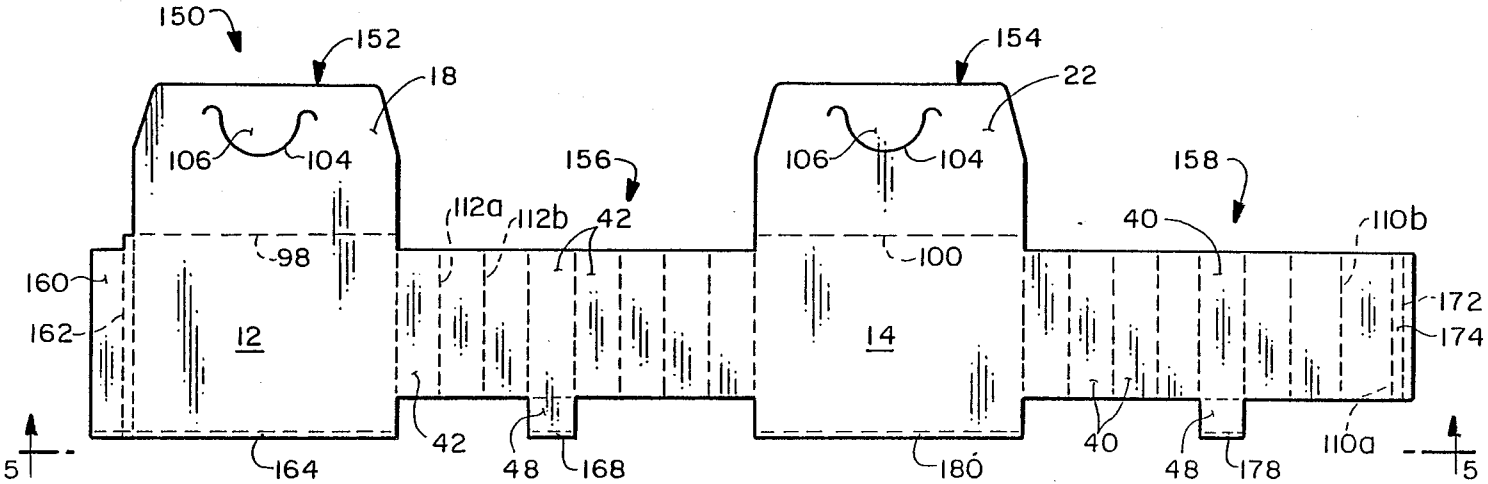
FIG. 4 is a plan view of a blank from which the insert of FIG. 1 is made.

Referring now to the drawings and initially to FIGS. 1–3, a pleated credit card insert is generally indicated at 10. The insert 10, as will be seen, is made of a flexible material and is illustrated in FIGS. 1–3 in an expanded configuration. Insert 10 includes a pair of opposed endwalls 12, 14 hingedly connected together at their lower ends by a welded seam 16. An end flap 18 is joined to the upper end 20 of endwall 12. In a similar manner, an end flap 22 is joined to the upper end 24 of endwall 14. The end flaps 18, 22 are preferably formed as integral extensions of the corresponding endwalls 12, 14, and are bent over in the manner shown in FIG. 1 so as to prepare the end flaps for engagement with the interior of a card case. As will be explained herein, the insert 10 may be mounted in a variety of different card cases, two different types being illustrated in FIGS. 2 and 3.

Referring again to FIG. 1, the insert 10 includes a pair of opposed sidewalls generally indicated at 30, 32 respectively. Sidewall 30 has upper and lower ends 34, 36, respectively. The sidewalls 30, 32 extend continuously between the endwalls !2, 14. The sidewall 30 is pleated with panels 40 so that the upper surface 34 of the sidewall has a zig-zag appearance. The sidewall 32 is similarly configured with pleated panels 42 and therefore has a zig-zag upper edge 44. According to one important feature of the present invention, the lower end 36 of sidewall 30 is spaced from the seam 16; and the sidewall includes a leg 48 extending between the sidewall lower edge and the seam.

Referring to FIG. 2, the insert 10 is shown mounted within a card case generally indicated at 60. Card case 60 includes an outer covering 62 of suitable flexible material such as leather or vinyl. Card case 60 further includes a hinged frame 64 having first and second U-shaped frame members 66, 68 joined together at pivot connections 70. Edge members 72, 74 crimpingly engage free ends of outer covering 62, securing the covering to the free ends of frame members 66, 68. The end members 72, 74 include inter-engaging snap-lock members 82, which hold the card case in a closed position.

As illustrated in FIG. 2, the outer covering 62 is bent along a medial fold line 86 to form front and rear cover portions of the card case. Outer cover 62 includes lateral edges 90, 92. As shown in the break-away portion of FIG. 2, card case 60 includes a retaining band 94 extending between the lateral sides 90, 92 of the rear outer cover portion. Although not visible in FIG. 2, a similar retaining band spans the width of the front outer portion of card case 60. In the preferred embodiment, the end flaps 18, 22 are hingedly connected to the endwalls 12, 14 by flexible hinge lines 98, 100. Preferably, the end flaps 18, 22 extend in a downward direction, that is, in a direction toward the seam 16 of the insert, the direction of pressure imparted to the insert by a user, at least during insertion of an article entity insert.

Referring again to FIG. 2, the end flap 18 is inserted between the retaining band 94 and the outer covering 62 so as to hold the end flap 18 captive at the rearward portion of card case 60. As can be seen in FIG. 1, a curved incision 104 is made in each end flap to form an upwardly extending locking tab 106, that is, a locking tab extending toward the open end of the insert. As can be seen in FIG. 2, the upwardly extending locking tab 106 cooperates with the hinge line 98 of end flap 18 to hold the end flap captive on retaining band 94. The particular form of incision 104, generally resembling a Greek uppercase Omega has been found especially effective for such retention. According to one aspect of the present invention, the hinge line 98, 100 joining the end flaps to the endwalls extend substantially across the entire width of the endwalls, at least two points adjacent the sidewalls of the insert. This provides a maximum retention capability against forces directed toward the seam 16 which, according to one aspect of the present invention require the greatest retention capability. If desired, portions of the fold lines 98, 100 can be removed particularly at the center portions thereof, although such has not been found to be necessary to add flexibility between the end flap and major body portions of the insert.

According to one aspect of the present invention, the sidewalls 30, 32 are pleated with an identical number of pleats so that the top and bottom edges of each sidewall have a zig-zag configuration. Further, the pleats in the sidewalls are carefully arranged so that the sidewalls are mirror images of one another. That is, the panels 40 of sidewall 30 are hingedly joined to one another along flexible joinder lines 110. In a similar manner, the panels of sidewall 32 are also flexibly joined at fold lines 112. Thus, it can be seen that the sidewalls contain a sequence of hinge lines which alternate in position from laterally inner to laterally outer positions. Referring to FIG. 1, the first fold line located immediately adjacent endwall 12 is located at a laterally inner position, being more closely spaced to the opposing sidewall 32 than the next adjacent fold line 110, herein identified as **110*b* for ease of reference. The first fold line 112, herein designated 112*a*, closest to endwall 12 is also located at a laterally inner position, being closer to the opposed sidewall 30, than the next adjacent fold line 112b. Accordingly, the fold lines of each sidewall 30, 32 immediately adjacent endwall 12 extend toward one another, thereby comprising mirror images of one another. The next adjacent pair of fold lines 110*b*, 112*b* extend away from one another at laterally outer positions, thereby forming a pocket recess having opposed ends 116*a*, 116*b*, respectively, and which is V-shaped in cross-section so as to be suitable for receiving a credit card or the like. Hence, one important feature of the present invention is that the ends of the pocket recesses directly opposed one another so as to aid in alignment with the lateral edges of a card inserted therein."In the embodiment illustrated in FIGS. 1–3, three such recesses are provided, there being three fold lines 110, 112 at laterally outer positions, for each sidewall 30, 32. In addition, pocket-like recesses are formed by the endwalls 12, 14** and the panels secured thereto. Thus, a total of five card-receiving pockets are formed in the insert of the illustrated embodiment.

As mentioned, insert 10 is preferably made from a flexible material, preferably a plastic such as vinyl. The pocket-like recesses are thereby made flexible and readily "fan-out" presenting enlarged recess openings at the upper edges of the sidewalls. Conversely, each trough-like recess of each card-receiving pocket has a minimum clearance adjacent the lower sidewall edge 36. According to one aspect of the preferred embodiment, this recess dimension is so small so as to retain a credit card therein, exerting pressure against the major surfaces of the credit card, at the bottom portion of each lateral edge thereof. Of course, more than one credit card can be inserted in each pocket-like recess and such is presented by way of an example of the flexibility of use possible with an insert constructed according to principles of the present invention.

Referring to FIG. 3, an insert 10 is shown installed in an alternative embodiment of a wallet, generally by the reference numeral 120. The card case 120 has an outer covering 122 made of leather, vinyl or the like. The outer covering 122 is folded at fold lines 124, 126 so as to form three wall portions, a front wall portion 128, a rear wall portion 130 and an overlapping cover wall portion 132. The fold lines 124, 126 are spaced apart such that the upper free end of front wall portion 128 lies close to the fold line 126 when the card case is in a collapsed position. Thereafter, the cover wall portion 132 is folded to partially overlie the front wall portion 128. Snap fasteners not visible in FIG. 3 secure the cover wall portion 132 to the front wall portion 128. As with the card case 60, the card case 120 includes front and rear retention bands 136, 138 extending generally between the lateral edges 140, 142 for retaining the end flaps 18, 22 in the manner indicated above with respect to FIG. 2. As illustrated in the broken-away portion of FIG. 3, the upwardly extending locking tab 106 receives the lower edge of retention band 136, being trapped between the retention band and the front wall portion 128. Thus, it can be seen that the insert 10 can accommodate a wide variety of card case configurations. Further, quite importantly, FIG. 3 illustrates the ability of insert 10 to adequately function and retain the shape and dimension of each pocket-receiving recess, even in a fully opened or expanded configuration, without requiring lateral restraints, such as those offered by the frame members 64, 68 illustrated in FIG. 2. A particular advantage of inserts according to the present invention is the dimensional stability or rigidity with credit cards being retained in each pocket-like recess despite inadvertent outward bowing of the sidewalls 30, 32 as might be accidentally caused by a user when the insert is in a fully opened position.

Figure 9:
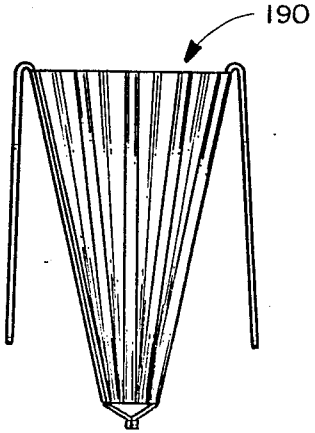
FIG. 9 is a side elevational view of a less-preferred insert of FIG. 3.
Figure 10:
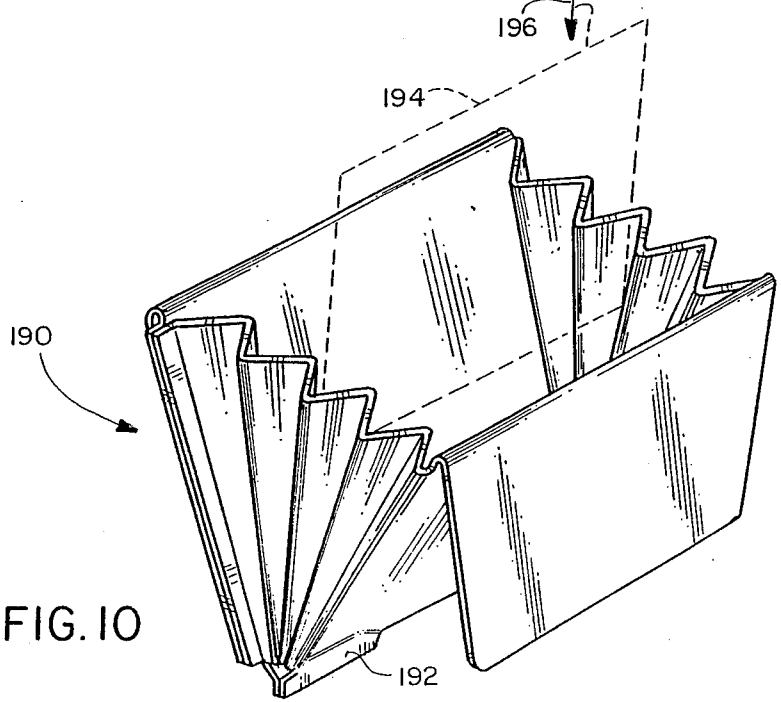
FIG. 10 is a perspective view of the insert of FIG. 9.

An important feature of credit card inserts constructed according to the present invention, is that the bottom edges 36 of the sidewalls are spaced from the seam 16, and that a leg-like extension 48 is provided at the mid portion of the sidewall, preferably at the middle pleat of the sidewall. Thus, the trough-like channels at the end of each card-receiving recess are tapered, or wedge-shaped having a wider opening at the top and a much smaller opening at the bottom edge 36 of the side panel. However, since the lower edge 36 of the side panel is spaced from the seam 16, the lower ends of the channels of each card-receiving recess have a wider spacing, than if the pleat panels were joined together at seam 16. This accounts for the substantial thickness of a credit card or a plurality of credit cards received in each pocket-like recess of the insert, and allows the credit card to pass downwardly below the lower edge of the sidewall. This in turn insures that the bottom lateral edge of the credit card will be more tightly engaged by the pleat panels engaging the credit card edge. If the panels were extended to or immediately adjacent the lower seam as illustrated in FIGS. 9 and 10, the credit cards would not be as securely retained in the insert, it being realized that the panels of each pleat have a limited lateral dimension and thereby engage only very limited surface area portions of the credit card. With an insert such as that illustrated in FIGS. 9 and 10, inadequate clearance to allow the credit card to fully seat within the insert occurs, and a user is likely to force the credit card into the lower end of each recess thereby causing distortion in the insert sidewalls while posing the risk of a lesser engagement force for each card edge. With the arrangement of the preferred embodiment, where the bottom edge of the sidewalls is spaced a substantial distance from the lower seam, distortion of the insert sidewalls is avoided and in particular, a spreading force tending to separate the seam 16 does not occur. Of course, the seam at the bottom of the insert could be made stronger, but the weak spot in the design would be found in the material of the endwalls, with the risk of tearing the endwalls thereby being increased. Such would require a heavier gage for the insert material to offset the increased strength of the bottom seam. This, in turn, would reduce flexibility of the sidewalls and in any event would increase material costs and would possibly complicate the fabrication procedure. Instead, with the desired spacing of the sidewall lower edges from the bottom seam, the insert can be made of a very thin light weight or thin gage material and conventional welded seams can be employed in a very economical fashion to produce an insert with considerable cost savings. Referring now to FIGS. 4–7, insert 10 is preferably constructed from a blank generally indicated at 150. Blank 150 has the important features of a front portion 152, a rear portion 154 alternating with side portions 156, 158, respectively, the front portion 152 includes endwall 12 and end flap 18, along with a manufacturer's tab 160 extending from endwall 12. The area 162 extending between the parallel-lines is used to form a seam 163 visible at the left hand end of FIG. 1. The bottom boarder of endwall 12, designated by the reference numeral 164 indicates the point of welding of wall 12 to seam 16.

The front portion 154 includes endwall 14 and end flap 22. The fold line 100 divides the wall 14 from the end flap 22. The blank 150 is formed from an integral sheet of flexible material, such as vinyl plastic. Preferably, the blank is stamped or otherwise cut from a larger sheet of plastic, and slit lines 104 are formed at the time of such stamping. Preferably, the same stamping operation forms the hinge lines 98, 100 as well as the hinge lines on the various sidewall portions.

The sidewall portion 156 extends between the endwall portions 150, 154 and includes the fold lines 112 which, when folded and welded form the sidewall 32 referred to above. A leg 48 extends from a middle panel 42 in a downward direction. The bottom margin 168 of the leg portion is welded to seam 16. The fold line joining endwall 12 to the immediately adjacent pleat panel 42 forms a first laterally outer hinge line. The next adjacent fold line **112*a* is made to overlie endwall 12, thereby assuming a laterally inner position, upon bending of the blank 150 about the first fold line joining endwall 12 to pleat panel 42. The folding continues in a zig-zag fashion until the bottom border 168 of leg 48 overlies the bottom margin 164 of endwall 12. The folding of the pleat panels 42 is illustrated schematically in FIG. 5**.

The sidewall portion 158 extends from endwall 14 and has a free end at which a manufacturer's tab 172 is located. The stripe or band portion 174 adjacent the free end, illustrated between parallel-lines indicates the welded seam formed with the stripe portion 162 as one of the final stages of assembly, as will be explained with reference to FIG. 6. A second extension leg 48 extends from a central pleat panel 40 and a lower border or edge 178 is joined to seam 16. The lower border 180 of endwall 14 also forms a portion of seam 16, being joined, preferably continuously, to the lower border 164 of endwall 12. As indicated in FIGS. 1 and 2, the legs 48 are sandwiched between the endwalls 12, 14 such that the lower borders 168, 178 thereof are sandwiched between the lower borders 164, 180 of the endwalls being together in a continuous welding operation.

Figure 5:
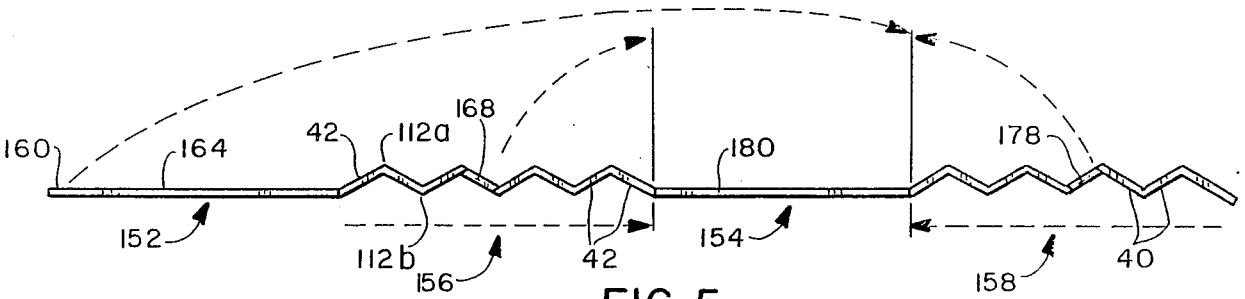
FIG. 5 is a end elevational view of the blank of FIG. 4, shown partly assembled.
Figure 6:
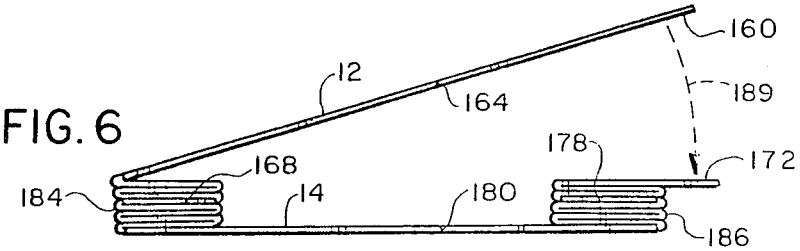
FIG. 6 is an end view similar to that of FIG. 5 but showing the blank in a further stage of development.

Referring now to FIG. 5, the pleat panels 42 are folded one on top of the other to form the stack 184 appearing at the left-hand end of FIG. 6. Similarly, the pleat panels 40 of sidewall portion of 158 are folded one on top of the other to form the stack 186 appearing at the right-hand end of FIG. 6. The manufacturer's tab 172 protrudes from stack 186 and lies, at least initially, in a plane generally parallel to the plane of endwall 14. As indicated in FIG. 6, the endwall 12 is then folded to overlie the pleat panel stacks 184, 186 and the opposed endwall 14. The manufacturer's tabs 160, 172 are brought together as indicated by arrow 189. Thereafter, the bottom borders 164, 180 of endwalls 12, 14 are pinched together trapping the bottom edges 168, 178 of legs 48 therebetween. With a continuous welding operation, the bottom margins 164, 168, 178 and 180 are joined together. Thereafter, the bands 162, 174 are welded to form the vertical welded seam 163 visible in FIG. 1. The manufacturer's tabs 160, 172 have been found convenient to facilitate the welding operation of bands 162, 174. After joinder of the welded seam 163, the manufacturer's tabs 160, 172 are severed from the insert, in the manner indicated in FIG. 7. Thus, with two simple welding operations and a single trimming step, fabrication of insert 10 is fully completed. It can now be seen from a study of the blank 150 that a minimal amount of waste results, and that fabrication is completed with two simple welded seams, using conventional equipment and techniques.

Figure 8:
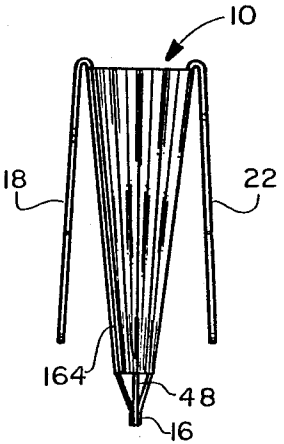
FIG. 8 is a side elevational view of the insert of FIG. 1.
Figure 7:
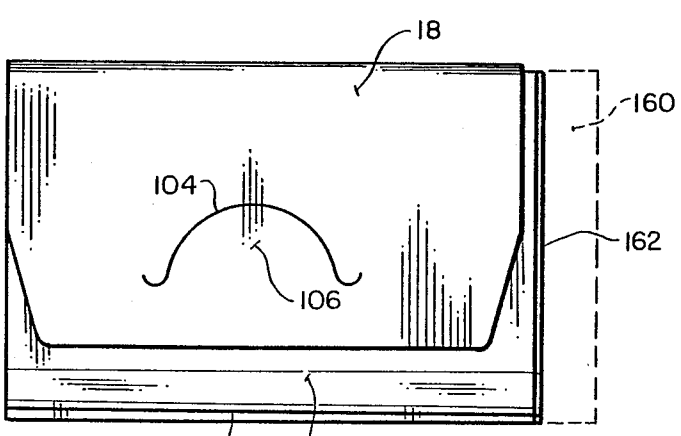
FIG. 7 is an end elevational view of the blank of FIG. 1.

FIGS. 8 and 9 are side elevational views of an insert 10 illustrating principles of the present invention, and a less preferred insert, respectively. The less preferred insert is illustrated in perspective in FIG. 10, and is characterized in having sidewall lower edges spaced very closely to the bottom seam of the insert. The preferred insert also lacks the center leg 48 and thus the sidewalls of the insert of FIG. 9 are less stable, more easily deflected as credit cards are inserted and withdrawn. The legs 48 have been found to provide a number of advantages. Firstly, with reference to FIG. 8, the legs 48 prevent an upward travel of the middle portions of the sidewall an action which, due to pinching of the credit cards adjacent the lower edges of the sidewalls, would cause the credit cards to shift in an upward direction, possibly becoming dislodged either in the process, or when the sidewalls are returned to their normal, unstretched configuration. Also, quite importantly, the legs 48 have been found to prevent a lateral separation of one middle sidewall portion from the other so as to introduce a greater spacing between the sidewalls 30, 32. This action, if great enough, might allow one or both ends of a recess pocket to pull away from the marginal edge of a credit card received therein. The loose credit cards may, in such a situation, prevent a return of the sidewalls to a normal unstretched condition causing the sidewalls to jam in a spread-apart condition. Further, the legs 48 also prevent a downward excursion of the central portions of the sidewalls, toward the welded bottom seam 16. While such excursion might not be particularly troublesome, the restoration of the sidewalls to their normal position might cause credit cards received in the pocket-like recesses to "ride up" in the recesses, subsequently causing disengagement or misalignment of the credit cards within the insert.

FIG. 10 shows a less preferred insert generally indicated at !90 having lower sidewall edges positioned very close to the bottom seam 192. A credit card 194 is inserted and withdrawn from a pocket-like recess formed at the mid-portion of the insert 190, when moved in the direction of double-headed arrow 196. The insert 190 of FIGS. 9 and 10 is presented herein by way comparison only, the insert 190 being useful to highlight the advantages of spacing the sidewall lower edges at a greater distance from the bottom seam of the insert and in providing legs at the central portion of the sidewall, extending between the sidewall lower edge and the bottom seam of the insert.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An expanding insert for holding cards and similar materials, comprising:

first and second endwalls of flexible material, having lower edges joined together at a seam;

a plurality of pleated sidewalls of flexible material between the endwalls, each sidewall having a plurality of pleats, each sidewall pleat having a sidewall panel with opposed upper and lower edges, with adjacent sidewall panels joined together at a fold line extending between the upper and lower edges thereof; and at least one leg extending to said seam from said lower edge of at least one of said sidewall panels of each sidewall at a mid-portion thereof, so as to space the lower edges of said sidewall panels on either side of said leg, from said seam.

2. The insert of claim 1 wherein said endwalls and said sidewalls are formed from a single blank of flexible material.

3. A blank from which an expanding insert for holding credit cards and similar materials is formed, comprising:

a first wall portion including a first endwall having top and bottom opposed edges and a free edge extending therebetween;

a first sidewall portion extending from the first endwall and including a serial succession of panels of preselected size and joined together by hinge lines so as to be foldable one on top of the other in a zig-zag pattern;

a second wall portion having a second endwall with top and bottom edges;

a second sidewall portion comprised of a second plurality of panels of equal number and of generally equal size with respect to the panels of said first sidewall portion, said second plurality of panels extending in a serial succession from the second endwall and including an end panel having a free edge, the panels of the second sidewall portion joined together along hinge lines so as to be foldable one on top of the other in a zig-zag pattern;

joining means for joining the free edges of the first endwall and the second sidewall end panel together so that, with a joinder of the endwalls at the bottom edges thereof, and a joinder of the free edges of the second sidewall end panel and the first endwall, the hinge lines of the first and second sidewall portions are arranged directly opposite one another, with pairs of wall panels forming recesses which oppose recesses of the other sidewall, with opposed recesses receiving and holding a card therebetween; and leg portions extending from wall panels of the first and second wall portions, respectively, the legs proportioned so as to extend to the bottom edges of the first and second endwalls so as to be joined thereto by said joining means.

4. The blank of claim 3 wherein each endwall includes a mounting flap extending therefrom so as to be receivable in a retaining loop of a case.

5. The blank of claim 4 wherein the mounting flap depends from the top edges of the endwalls, being foldable so as to extend in a generally downward direction.

6. A card case assembly for holding a plurality of credit cards and similar materials, comprising:

a n outer case having a pair of opposed walls, each wall having a retaining loop;

first and second endwalls of flexible material, having upper edges and also having lower edges joined together at a seam;

a plurality of pleated sidewalls of flexible material between the endwalls, each sidewall having a plurality of pleats, each sidewall pleat having a sidewall panel with opposed upper and lower edges, with adjacent sidewall panels joined together at a fold line extending between the upper and lower edges thereof;

at least one leg extending to said seam from said lower edge of at least one of said sidewall panels of each sidewall at a mid-portion thereof, so as to space portions of the lower edges of said sidewall panels on either side of said leg, from said seam; and joining means for joining the endwalls to the walls of the outer case.

7. The case assembly of claim 6 wherein said joining means comprises said retaining loops joined to the case walls and mounting flaps extending from the upper edges of the endwalls dimensioned so as to be receivable in the retaining loops.

8. The case assembly of claim 6 wherein the case includes a cover panel extending from one of said case walls, and joined thereto with hinge means so as to overlie the other case wall when the case walls are drawn toward one another.

9. The case assembly of claim 6 wherein the case includes a frame having two rigid frame portions connected with hinge means, the frame portions having free ends joined to the case walls and forming an opening through which the sidewalls are received, the frame portions lying adjacent the upper edges of the sidewalls when the case is opened.

* * * * *